United States Patent [19]

Moore et al.

[11] Patent Number: 4,637,082

[45] Date of Patent: Jan. 20, 1987

[54] WATERBED WITH REMOVABLE SIDE CUSHIONS

[75] Inventors: Jerry Moore; Dennis W. Yanglin, both of Cloverdale, Calif.

[73] Assignee: New World Manufacturing, Inc., Cloverdale, Calif.

[21] Appl. No.: 716,155

[22] Filed: Mar. 26, 1985

[51] Int. Cl.[4] ..... A47C 27/10

[52] U.S. Cl. ..... 5/452; 5/451

[58] Field of Search ..... 5/451, 452, 455, 449, 5/450, 474

[56] References Cited

U.S. PATENT DOCUMENTS

| | | | |
|---|---|---|---|
| 3,735,432 | 5/1973 | Kreten et al. | 5/451 |
| 4,187,566 | 2/1980 | Peterson | 5/451 |
| 4,334,331 | 6/1982 | Santo | 5/451 |
| 4,352,217 | 10/1982 | O'Rourke | 5/451 |
| 4,491,993 | 1/1985 | Santo | 5/452 |
| 4,513,463 | 4/1985 | Santo | 5/452 |

FOREIGN PATENT DOCUMENTS

| | | | |
|---|---|---|---|
| 2435245 | 5/1980 | France | 5/451 |

*Primary Examiner*—Alexander Grosz

*Attorney, Agent, or Firm*—Flehr, Hohbach, Test, Albritton & Herbert

[57] ABSTRACT

A waterbed having peripheral resilient cushions for supporting its perimeter, said cushions being retained in position by means of a plurality of slings formed by inward extensions secured to the liner at a distance away from the vertical projection of the cushion itself such that when a water bag is inserted within the liner and the cushions, the weight of the water tends to compress the sides of the slings together thereby applying inward force on the cushions to somewhat counteract the outward force of the water itself.

7 Claims, 12 Drawing Figures

WATERBED WITH REMOVABLE SIDE CUSHIONS

The present invention is directed to a waterbed and more specifically to a waterbed which provides a cushion about its perimeter which serves to maintain the mattress height at the perimeter and, to some extent, maintain the perimeter shape. Means are provided to give additional rigidity to the cushioned side walls to prevent their flexing upon the effect of water pressure from the water bag within, the additional means being in the form of a liner for the water bag itself which liner also envelopes the cushions and is secured to itself so as to form a sling which constrains the outward movement of the cushions.

Since their original popular appearance as a mere bag or bladder for containing water, waterbeds have advanced steadily with numerous advances for maintaining the peripheral shape of the bed in a rectangular or other desired form, for providing comfort to the occupant particularly when entering and leaving the bed and for confining water which may leak after the water bag is punctured or otherwise parted.

Generally speaking, to retain the peripheral shape of the bed the usual method was originally, and to a great extent still is, the use of a solid frame such as wood to contain the water bag in its desired shape. In order to overcome the discomfort of the hard edges of the wood or other rigid frame, cushions have been provided along the tops of the frames. In addition, a relatively high pressure "air frame" has been employed, the pressure of the "air frame" being sufficiently high to withstand the weight of the occupant as he leaves or enters the waterbed. The "air frame" does, of course, provide substantial relative comfort compared with the rigid wood frame. In order to retain water which might be spilled from a cut or otherwise parted water bag, a liner was provided originally in the form of an impervious vinyl open topped bag secured to the wooden frame so as to contain any such leakage. Later, the liner took the form of a second water bag but with a major portion of the top open so as to permit access to the valve for filling the inside bag or bags.

With respect to the "air frame" waterbeds, or waterbeds that otherwise use some form of pneumatic cushion at their edges with or without the rigid frame, it has been recognized that either the water bag or the air bag may be pierced causing leakage in one or the other but not both. Thus, it became recognized that means should be provided to readily replace the air bag whether it be a single unit or comprised of multiple units, one for each of the linear sides of the waterbed. Such improvements have taken the form of removable perimeter supports which may be slid axially in and out of pockets secured along each of the rectilinear edges of the water bag. However, the openings to provide axial removal of the supports left the waterbed with an odd shape having cut away corners rather than the usual squared corners such as have come to be expected not only on a standard innerspring bed and mattress but also on waterbeds.

Thus, there was a need in the waterbed art for the provision of a resilient peripheral support for a water bag which may relatively easily be removed for repair whether that repair be patching a hole in the vinyl air bag or even for the replacement of the entire resilient support structure such as if a resilient foam structure has been subjected to staining or some other mistreatment which would harden or otherwise make it undesirable for continued use. It is, therefore, an object of this invention to provide an improved waterbed structure with removeable peripheral support cushions.

It is a more specific object of the invention to provide an improved waterbed as above, in which the resilient peripheral support structure is retained in position by the waterbed liner, the liner structure itself forming slings along each of the rectilinear sides of the water bag with the cushion being removable either by opening the slings or by passing the cushion through openings at the ends of the slings.

It is a further object of the invention to provide an improved waterbed as described above wherein the water bag cooperates with the slings to maintain the rectilinear condition of the peripheral supports by restricting their movement.

Referring to the drawings, there is shown in FIG. 1 a perspective view of a waterbed in accordance with the present invention showing the water bag encased in resilient peripheral supports retained by slings formed in the liner.

Figure 1:
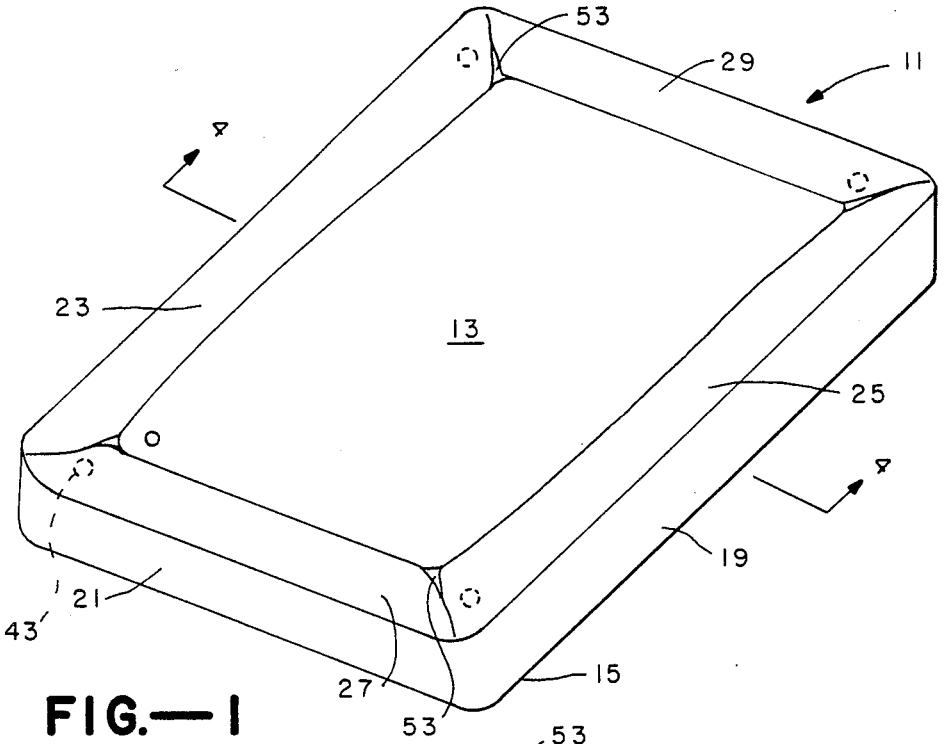
Figure 2:
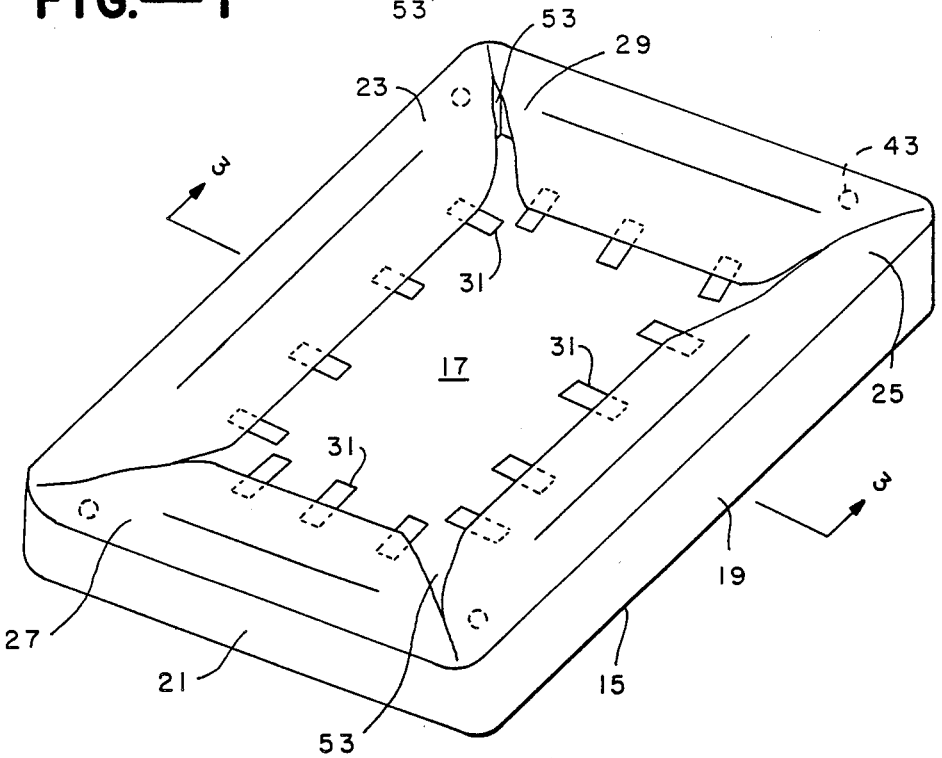
FIG. 2 is a perspective view of the waterbed, as shown in FIG. 1, but with the water bag removed.

Referring now particularly to the drawing, there is shown in FIG. 1 a waterbed 11 which includes a water bag 13 surrounded by a liner 15. The liner 15 not only includes a bottom 17 (not shown in FIG. 1 but seen in FIGS. 3 and 4) together with generally upright rectilinear sides 19 and ends 21. Further extensions of the upright sides 19 form inwardly extending portions 23 and 25 while continuations of the ends 21 form inward extensions 27 and 29. As can be seen in FIG. 2, with the water bag 13 removed, the extensions 23 and 25 cooperate with the sides 19 and the bottom 17 to form slings. Likewise the inward extensions 27 and 29 cooperate with the ends 21 and the bottom 17 to form two additional slings.

The ends of the inwardly extending portions 23, 25, 27 and 29 are secured to the bottom 17. In the embodiment of the invention shown particularly in FIGS. 2 and 5, the manner of securing the extensions to the bottom 17 is by means of a hook and loop fastener wherein one element, for instance the loop portion, 31, is permanently secured to the bottom 17 in any convenient manner such as by heat sealing or adhesive, for example. Similarly, the hook portion 33 is secured to the end edges of the inwardly extending members 23, 25, 27 and 29 as typically shown in FIG. 5. As can best be seen in FIG. 3, the slings formed in part by the inwardly extending members 23 and 25 serve to retain resilient side peripheral supports 35 and 37. Similarly, the slings formed in part by the inwardly extending members 27 and 29 serve to retain end peripheral supports 39 and 41. The resilient peripheral supports 35, 37, 39 and 41 may, as shown, be in the form of rectilinear air bags or cushions each having a valve 43 for the admission of air from any desirable means such as from the exhaust of a normal home vacuum cleaner. Alternatively, the resilient peripheral supports may be in the form of foam rubber or the like or even the combination of air bag and foam rubber.

Figure 5:
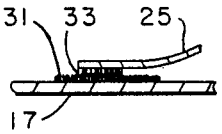
FIG. 5 is a detailed view taken along the lines 5—5 of FIG. 3 showing one form of attachment of the upper portion of the sling to the bottom of the liner.
Figure 7:
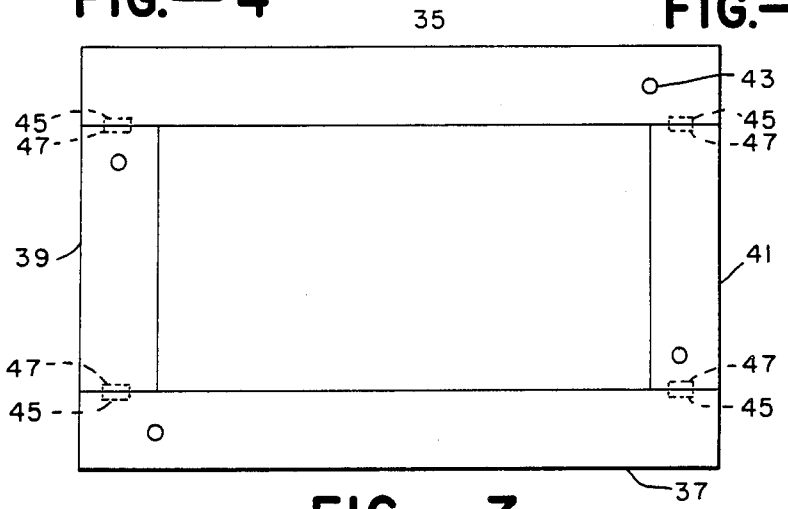
FIG. 7 is a plan view showing the position of the resilient peripheral supports and their attachment to each other but with the waterbed liner and slings not being shown for clarity.
Figure 8:
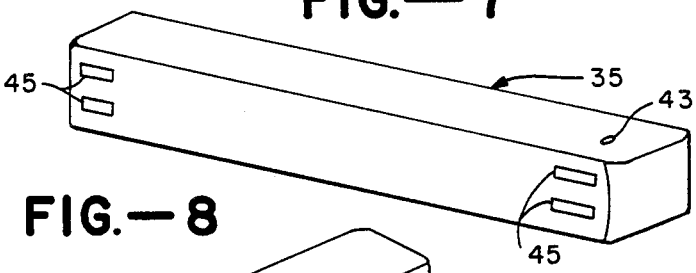
FIGS. 8 and 9 are perspective views respectively of side and end resilient peripheral cushions showing a preferred means of attachment.
Figure 9:
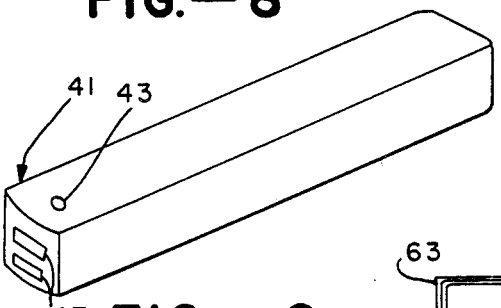

Referring specifically to FIGS. 7, 8 and 9 it is noted that the side cushions 35 and 37 each incorporate fastening means 45 near the ends thereof on their inner surface. Such fastening means may take the form of the loop portion of a loop and hook fastener. The corresponding hook portion 47 is secured at the ends of the end portions 39 and 41. The hook and loop portions cooperate to secure each of the cushions 35, 37, 39 and 41 in a generally rectangular array as shown in FIG. 7. In the use of the waterbed as shown in FIGS. 1 through 5 and 7 through 9, the liner 15 is placed on a flat surface onto which the bed is to be located. The flat surface may be a rigid platform such as of plywood or the like, or it may be a boxspring of a normal bed. Next the resilient cushions are placed in position and if the cushions are in the form of air bags it is preferable that they be inflated prior to positioning within the liner 15, although this is not essential. The position of the cushions in a liner of the type shown in FIGS. 2 and 5, is accomplished by merely releasing the hook and loop fasteners, connecting the extensions 23, 25, 27 and 29 to the bottom 17, placing the cushions in the pocket of the slings formed by such extensions and bottom. The fasteners are then reconnected such that the extensions 23, 25, 27 and 29 are drawn over a free space 49 between each cushion and the extension itself as shown typically in FIG. 3, with respect to the cushion 35 and the extension 23. Such placement of the cushions should also include the connection of the hook and loop fasteners 45 and 47 on the cushions themselves so as to assure that they take the general position as shown in FIG. 7.

Figure 3:
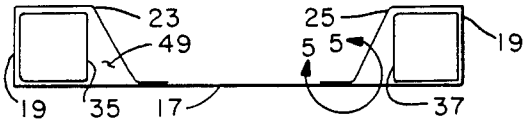
FIG. 3 is a sectional view along the lines 3—3 of FIG. 2 showing particularly the position of the slings when there is no water bag in the waterbed.
Figure 4:
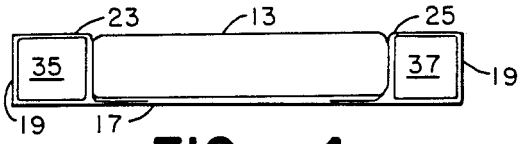
FIG. 4 is a view taken along the lines 4—4 of FIG. 1 and is similar to FIG. 3 but showing the position of the slings when the water bag is in place.

After the cushions have been so secured in the pockets of the respective slings, the empty water bag 13 is placed on the bottom 17 within the confines of the cushions as well as the inward extensions 23, 25, 27 and 29. The water bag 13 is then filled with water until it takes on the condition, as shown in FIGS. 1 and 4 and the extensions 23, 25, 27 and 29 take the position as shown in FIG. 4. It will be noted that upon filling the water bag 13 with water the weight of the water forces the extensions to be tightened by increasing their linear path or extent from that as shown in FIG. 3 to the longer and more tortuous path as shown in FIG. 4. Thus the weight of the water acting upon the extensions serves somewhat to tighten the slings about the cushions 35, 37, 39 and 41 thereby tending to roll the cushions inwardly so as to maintain them in their generally rectilinear condition despite the outward force of the water within the bag 13 along its upright walls.

The extensions 23, 25, 27 and 29 may originally be drawn taut, as shown in FIG. 3, but need not be so. Alternatively, each extension may form a curve from its point of contact with the cushion (e.g. cushion 35) to the bottom 17 so long as a free space 49 is formed into which the extension may be forced by the filled water bag. Thus, the linear path or extent of the extension from the top of the cushion to the point of attachment to the bottom 17 is elongated when the water bag is filled. This elongation serves to tighten the extensions 23, 25, 27 and 29 and thus tends to roll the cushions inwardly.

The action of the slings with the weight of the filled water bag on their ends, has been clearly demonstrated. To this end a waterbed, as shown in FIG. 1, was fully assembled as described above. After completion of the assembly, the top of the water bag 13 was extensively sliced so as to permit water spillage. The spillage was totally contained by the liner 15 but the cushions 35, 37, 39 and 41 were quickly bowed outward. It was, therefore, clear that the weight of the filled waterbag acting upon the slings was an effective factor in maintaining the rectilinear shape of the waterbed. After spillage of the water, the weight of any water remaining in the water bag was buoyed by the water captured in the bottom of the liner 15. Thus the extensions 23, 25, 27 and 29 were no longer forced into the position shown in FIG. 4 but rather were stretched horizontally outward by the pressure of the water in the liner 15. The horizontally outward force of the water had caused outward bowing of the cushions.

Figure 6:
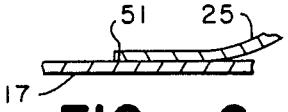
FIG. 6 is a view similar to FIG. 5 but showing an alternate form of attachment.

Instead of the releasable connection for the extensions 23, 25, 27 and 29 to the bottom 17, as exhibited by the hook and loop combination shown in FIG. 5, the extensions could be permanently secured to the bottom 17 such as by a heat seal 51, as shown in FIG. 6. With an arrangement such as shown in FIG. 6 it is clear that the sling may not be opened at the ends of the extensions 23, 25, 27 and 29 as is the case with the hook and loop connection but rather the cushions may be individually inserted at the corner separations 53 formed by the individual extensions 23, 25, 27 and 29 as shown in FIGS. 1 and 2. It must be remembered that the cushions are not absolutely rigid but rather will bend slightly and likewise the material of the liner 15 is sufficiently pliable that it may be pushed out of the way at the opening 53 to permit passage of the cushion. Thus, for instance, the left portion of extension 29, as shown in FIGS. 1 and 2, may be pushed downward and the adjacent portion of extension 23 raised slightly so as to increase the opening 53 to permit passage of the cushion. It should be recognized that while it might be more difficult, insertion or removal of a cushion in this manner may even be accomplished with the water bag 13 filled with water. It will, of course, be necessary to somewhat relieve the pressure of the water at the edge of the bag adjacent the cushion to be inserted or removed.

Figure 10:
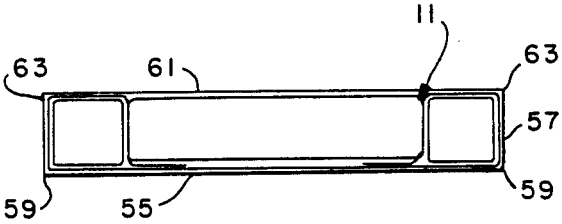
FIG. 10 is a view similar to FIG. 4 but showing a desirable addition in the form of a removable mattress ticking about the entire waterbed so that it has the outward appearance of an innerspring mattress.

Referring to FIG. 10, the waterbed 11 in accordance with the invention, is shown with a further improvement including totally enclosing ticking, of fabric or other mattress material. The ticking may be quilted as on more modern mattresses or the standard ticking of the more institutional mattresses available today. Particularly the ticking need not be waterproof and preferably is capable of permeating air. The ticking includes a bottom 55 and an upstanding wall portion 57 which completely surrounds the upright sides of the waterbed 11. Preferably the bottom 55 and sides 57 are sewn together at a bead 59 extending about the entire periphery of the bottom 55. At the upper edge of the sides 57 a top 61 is removably secured such as by means of a zipper 63. Thus the top 61 may be removed or at least opened so as to service the waterbed within. With the arrangement as shown in FIG. 10, the mattress, if placed on top of a normal boxspring, will take on the appearance of the usual bed without a visual clue that it is, in fact, a waterbed.

Figure 11:
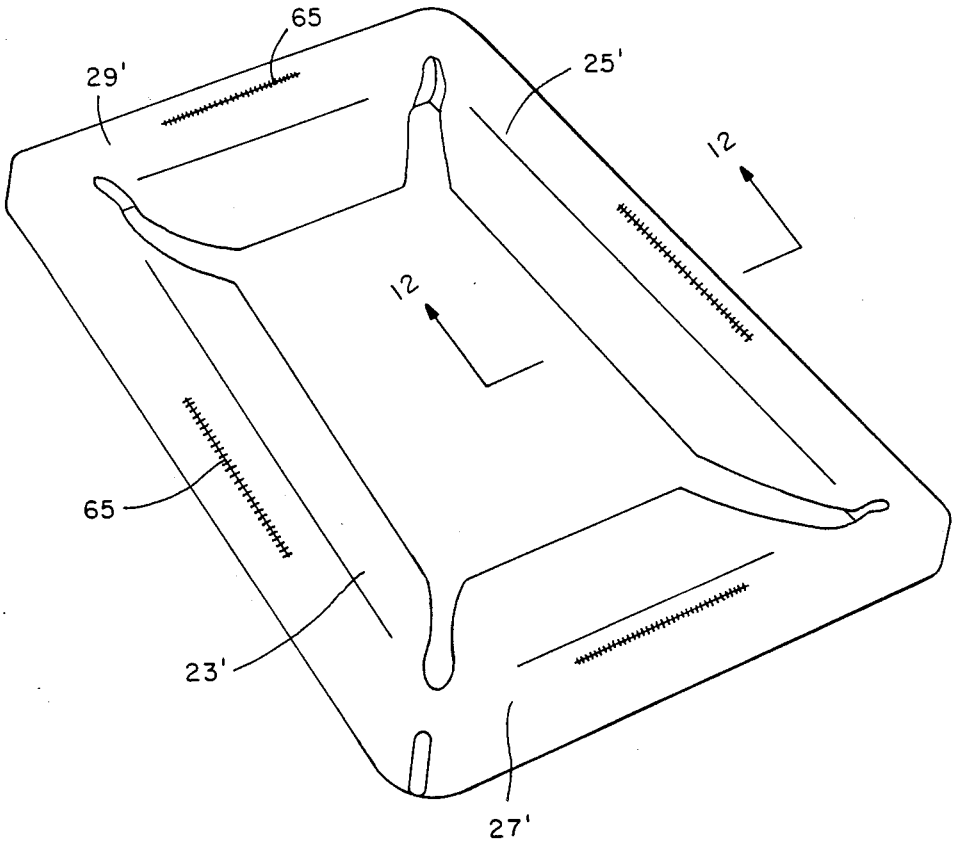
FIG. 11 is a perspective view, similar to FIG. 2 but showing alternative sling opening means.
Figure 12:
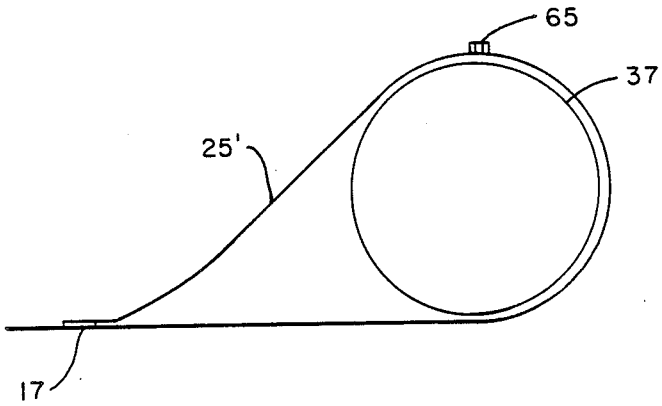
FIG. 12 is a sectional view taken along the lines 12—12 of FIG. 11.

Referring to FIGS. 11 and 12 still another embodiment of the invention is shown wherein the inward extensions 23', 25', 27' and 29' each include an openable closure 65, such as a zipper. The closures 65 are located adjacent the upright sides 19 and ends 21 and positioned to be accessible at the top of the cushions. The closure 65 may be used to insert or remove the individual peripheral cushion.

What is claimed is:

1. A waterbed comprising a water impermeable liner having a rectangular bottom portion, generally upright rectilinear peripheral portions extending from the edges of the bottom portion and extensions of said peripheral portions extending inwardly toward the center of said bottom portion, means for attaching said extensions to said bottom portion to thereby form a plurality of slings each having its loop portion parallel to one side of said rectangular bottom portion, adjacent edges of the extensions being separated from each other to provide an opening, a resilient cushion disposed in each of said slings thereby forming a rectangular peripheral support and a water bag positioned on said rectangular bottom portion within said rectangular peripheral support and overlying said means for attaching said extensions, each of said extensions defining a first linear path from the upper surfaces of the respectively enclosed cushion to the means for attaching when said water bag is empty of water and a second longer linear path from the upper surface of the respectively enclosed cushion to the means for attaching when said water bag is filled with water whereby, when said water bag is filled with water, downward pressure on said extensions tends to urge said resilient cushions inwardly.

2. A waterbed as defined in claim 1 wherein said means for attaching said extensions to said bottom portion comprises hook and loop fasteners.

3. A waterbed as defined in claim 1 wherein said means for attaching said extensions to said bottom portion comprises a permanent attachment.

4. A waterbed as defined in claim 1 together with means for removably attaching adjacent ones of said resilient cushions to each other.

5. A water bed as defined in claim 1 wherein said resilient cushions comprise air bags.

6. A waterbed as defined in claim 1 wherein each of said extensions include a zipper adjacent and parallel to the generally upright rectilinear portion.

7. A waterbed as defined in claim 1 together with a covering about said liner, said resilient cushions and said water bag, said covering including a ticking bottom and ticking upright sides, together with a ticking top removably attached to said ticking upright sides.

* * * * *